US009238299B2

(12) United States Patent
Noah

(10) Patent No.: US 9,238,299 B2
(45) Date of Patent: Jan. 19, 2016

(54) SUPPORT ASSEMBLY

(71) Applicant: Penn United Technologies, Inc., Cabot, PA (US)

(72) Inventor: Mark P Noah, Butler, PA (US)

(73) Assignee: Penn United Technologies, Inc., Cabot, PA (US)

( * ) Notice: Subject to any disclaimer, the term of this patent is extended or adjusted under 35 U.S.C. 154(b) by 26 days.

(21) Appl. No.: 14/148,901

(22) Filed: Jan. 7, 2014

(65) Prior Publication Data

US 2014/0191097 A1 Jul. 10, 2014

Related U.S. Application Data

(60) Provisional application No. 61/897,445, filed on Oct. 30, 2013, provisional application No. 61/749,552, filed on Jan. 7, 2013.

(51) Int. Cl.

| | |
|---|---|
| ***A47G 29/02*** | (2006.01) |
| ***B25H 1/08*** | (2006.01) |
| ***B25H 1/02*** | (2006.01) |

(52) U.S. Cl.
CPC ... *B25H 1/08* (2013.01); *B25H 1/02* (2013.01)

(58) Field of Classification Search
CPC ..... B25H 1/08; B25H 1/02
USPC ..... 248/228.1, 250, 228.3, 228.5, 316.4, 248/316.8, 231.41; 211/193
See application file for complete search history.

(56) References Cited

U.S. PATENT DOCUMENTS

| | | | | |
|---|---|---|---|---|
| 3,053,494 | A * | 9/1962 | Stoll | 248/228.3 |
| 3,857,643 | A * | 12/1974 | Bardocz | 403/63 |
| 4,023,684 | A | 5/1977 | Saul | |
| 4,519,512 | A | 5/1985 | Frazier et al. | |
| 4,826,113 | A * | 5/1989 | Winters | 248/72 |
| 5,112,015 | A * | 5/1992 | Williams | 248/236 |
| 5,165,555 | A | 11/1992 | Anatalio | |
| 6,315,137 | B1 * | 11/2001 | Mulford | 211/193 |
| 8,100,369 | B2 * | 1/2012 | Osborn et al. | 248/72 |
| 2005/0224287 | A1 | 10/2005 | LaBrash | |

OTHER PUBLICATIONS

Penn United Technologies, Inc., PCT/US2014/010441 International Search Report, Dated May 6, 2014, 4 Pages.

* cited by examiner

*Primary Examiner* — Gwendolyn Baxter
(74) *Attorney, Agent, or Firm* — Eckert Seamans Cherin & Mellott, LLC; David C. Jenkins

(57) ABSTRACT

A support device is provided. The support device includes a support assembly with an elongated first body defining a cantilever mounting and a support surface.

18 Claims, 19 Drawing Sheets

SUPPORT ASSEMBLY

CROSS-REFERENCE TO RELATED APPLICATIONS

This application claims priority from U.S. Provisional Patent Application Ser. No. 61/897,445, filed Oct. 30, 2013, entitled "Latching Coupling Assembly," which Application is a continuation-in-part of U.S. Provisional Patent Application Ser. No. 61/749,552, entitled "Support Assembly," filed on Jan. 7, 2013.

BACKGROUND OF THE INVENTION

1. Field of the Invention

The disclosed and claimed concept relates to a support device and, more specifically, to a support device that may be coupled to a generally horizontally extending mounting beam.

2. Background Information

I-beams, as well as support elements having other cross-sectional shapes, are used in the construction of buildings. I-beams include a web having two flanges, one flange disposed at each end of the web. The flanges extend generally parallel to each other and generally perpendicular to the web. Other support elements, such as, but not limited to beams with a "T" shaped cross-section, "C" or "[" shaped cross-section, and "L" shaped cross-section (also known as angles) also include a web and at least one generally perpendicular flange. The following description shall use an I-beam as an example, but it is understood that any support element with a generally perpendicular flange may be used in place of an I-beam.

Such support elements may not be enclosed in a wall. Further, an I-beam may be disposed in a generally horizontal orientation with the flanges extending in generally horizontal planes. In this configuration, the flanges may be used as shelves. The flanges, however, tend to have a limited length and do not have the space to support large, or numerous, items.

Further, the elements of a support assembly are, typically, coupled with threaded coupling assemblies such as, but not limited to, nuts and bolts, or, pins disposed in keyed openings. Nuts and bolts have the advantage of forming a "tight joint." That is, as used herein, a joint wherein the elements are biased toward each other with more than ten pounds of force form a "tight joint." Such joints maintain the joined elements in a generally fixed configuration but are time consuming to assemble. Pins disposed in openings, including but not limited to keyed openings, can be assembled or disassembled quickly, but create a "loose joint." That is, as used herein a joint wherein the elements are not biased toward each other is a "loose joint." There is, therefore, a need for a coupling assembly that is easy and quick to assemble, but which creates a "stiff joint." That is, as used herein, a joint wherein the elements are biased toward each other with ten pounds of force, or less, form a "stiff joint."

There is, therefore, a need for a support device that may be coupled to an I-beam. There is a further need for a support device that may be a locking component to lock the support device to the I-beam.

SUMMARY OF THE INVENTION

These needs, and others, are met by an embodiment of the disclosed concept which provides a support device including a support assembly including an elongated first body defining a cantilever mounting and a support surface. The first body cantilever mounting corresponds to the first flange. In this configuration, the first body may be coupled to the first flange and the support surface may be used to support a shelf. It is understood that two support devices, disposed in a spaced relation, are coupled to the first flange and used to support elements such as, but not limited to, a shelf.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
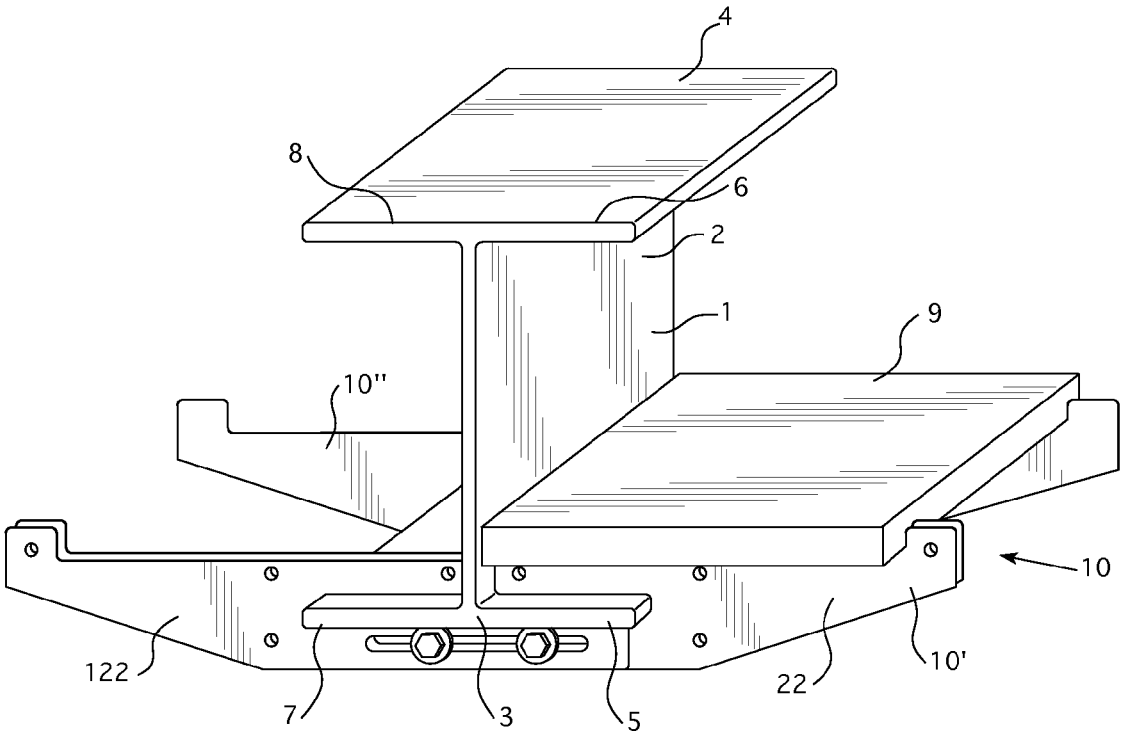
FIG. 1 is an isometric view of a support device coupled to a mounting beam having an I-shaped cross-section. Two different embodiments of support assemblies are shown.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the statement that two or more parts or components "engage" one another shall mean that the elements exert a force or bias against one another either directly or through one or more intermediate elements or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, as used herein, "loosely correspond" means that a slot or opening is sized to be larger than an element disposed therein. This means that the increased size of the slot or opening is intentional and is more than a manufacturing tolerance. Further, with regard to a surface formed by two or more elements, a "corresponding" shape means that surface features, e.g. curvature, are similar.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "at" means on or near.

As used herein, "cantilever" means a projecting beam or other horizontal member supported at one or more points.

As used herein, a "cantilever mounting" is a coupling structured to be coupled to a cantilever element. The "cantilever mounting" corresponds to the shape of the cantilever element to which it is attached. That is, for example, if the cantilever element is a planar member, such as but not limited to a flange, the "cantilever mounting" is a slot.

Figure 2:
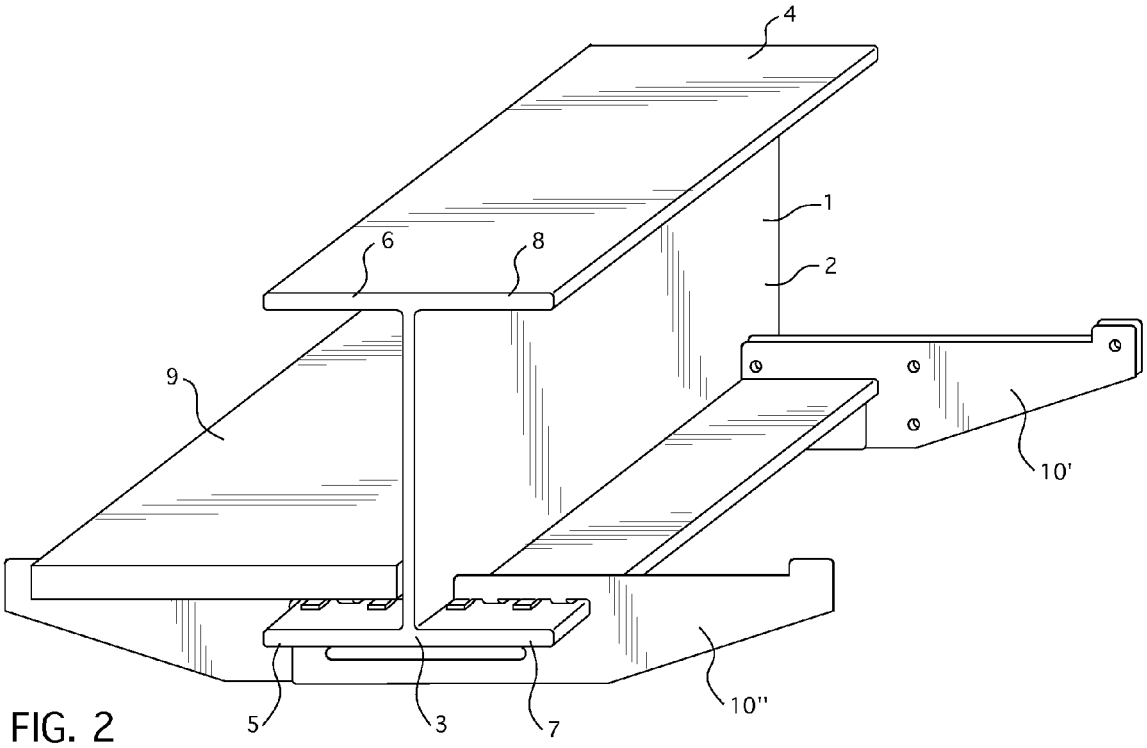
FIG. 2 is an isometric view of a support device coupled to a mounting beam having a I-shaped cross-section. Two different embodiments of support assemblies are shown.

As shown in FIGS. 1 and 2, a mounting beam 1 includes a web 2 and a generally perpendicular first flange 3. As shown, the mounting beam 1 is an "I" beam, i.e. a beam having a generally "I" shaped cross-section, including a web 2, a first flange 3 and a second flange 4. The two flanges 3, 4 are disposed at opposite ends of the web 2. Further, each flange 3, 4, has a first portion 5, 6, and a second portion 7, 8, wherein the first and second portions 5, 6 and 7, 8, are disposed on opposing sides of the web 2. That is, for example, first flange first portion 5 extends generally perpendicular to the web 2, and, first flange second portion 7, extends generally perpendicular to the web 2 in a direction opposite the first flange first portion 5. Further, it is understood that other support elements, such as, but not limited to beams with a "T" shaped cross-section, "C" or "[" shaped cross-section, and "L" shaped cross-section (also known as angles) may also be a mounting beam 1 even though such support elements may have a flange with a single portion and/or a single flange.

A support device 10 is also shown in FIGS. 1 and 2. More specifically, FIGS. 1 and 2 show a first exemplary embodiment of a support device 10' and a second exemplary embodiment of a support device 10". It is understood that at least two support devices 10 are used to support an element such as, but not limited to, a shelf 9. That is, at least two support devices 10 are disposed in a spaced relationship and a shelf 9 extends between the at least two support devices 10. The at least two support devices 10 may be the same embodiment or may include a combination of embodiments, as shown.

Figure 3:
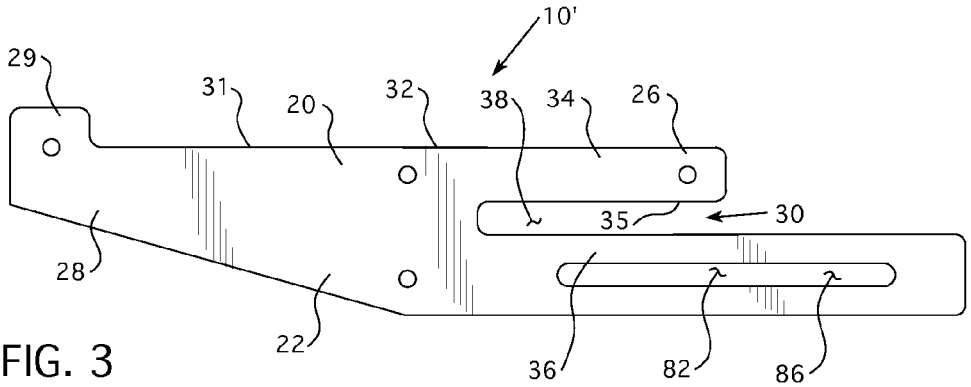
FIG. 3 is a side view of a first embodiment of a support device.
Figure 4:
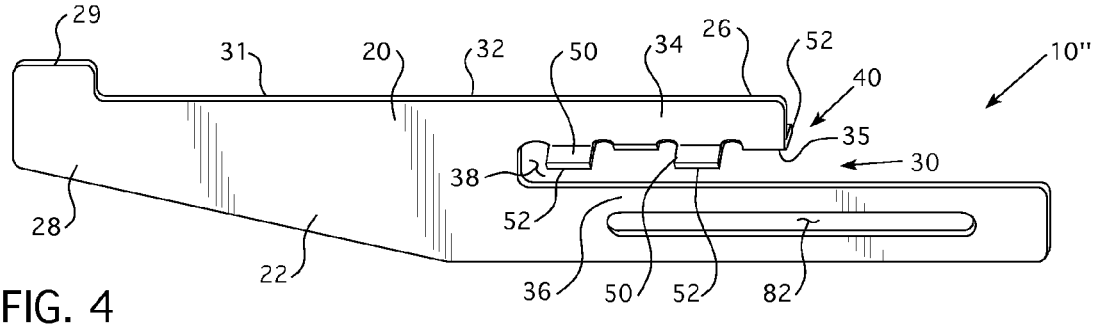
FIG. 4 is an isometric view of a second embodiment of a support device.

As shown in FIGS. 3 and 4, in each of the first and second embodiments, the support device 10', 10" includes a support assembly 20. The support assembly 20 includes an elongated first body 22 and may include a second body 122, discussed below. As shown, in the first and second exemplary embodiments, the first and second bodies 22, 122 are made from a thin metal. As discussed below, in another exemplary embodiment, the first and second bodies 22, 122 have a greater thickness and may be made from a plastic or similar material. The first body 22 includes a proximal end 26 and a distal end 28. As used herein, the "first body proximal end 26" is closer to the web 2 when the support device 10 is attached to the mounting beam 1. Conversely, the "first body distal end 28" is spaced from the web 2 when the support device 10 is attached to the mounting beam 1. The first body 22 defines a cantilever mounting 30 and a support surface 32. The first body support surface 32 is structured to support a shelf 9. That is, in one exemplary embodiment, the first body 22 includes an upper surface 31 that is generally planar. In another exemplary embodiment, shown in FIG. 5, the first body upper surface 31 includes a number of contoured recesses 33. The contoured recesses 33, as shown, are arcuate and correspond to the curvature of a tubular element such as, but not limited to, a pipe. The first body support surface 32, or the first body upper surface 31, may include an upwardly extending tab 29 at the first body distal end 28.

The first body cantilever mounting 30 corresponds to the first flange first portion 5. That is, the first body cantilever mounting 30 has a cross-sectional shape that corresponds to the first flange first portion 5. If the first body cantilever mounting 30 does not snuggly correspond to the thickness of the first flange first portion 5, the first body cantilever mounting 30 may include shims (not shown) or other spacers (not shown) structured to occupy space between the first flange first portion 5 and the first body cantilever mounting 30. In another exemplary embodiment, the first body cantilever mounting 30 has a cross-sectional shape that snuggly corresponds to the first flange first portion 5. In this configuration, the first body 22 may be coupled to the first flange first portion 5 by disposing the first flange first portion 5 in the first body cantilever mounting 30.

More specifically, the first body cantilever mounting 30 includes an upper member 34 and a lower member 36. The first body cantilever mounting upper member 34 and the first body cantilever mounting lower member 36 are disposed in a spaced relationship thereby defining a first cantilever mounting slot 38. The first cantilever mounting slot 38 has a vertical height that corresponds to the first flange first portion 5 and, in another exemplary embodiment, snuggly corresponds to the first flange first portion 5. When the mounting beam 1 includes two flange portions, e.g. first flange first portion 5 and first flange second portion 7, on opposing sides of web 2, the first body cantilever mounting lower member 36 is, in an exemplary embodiment, longer than the first body cantilever mounting upper member 34. In this configuration, the first body cantilever mounting 30 resists the rotation of the first body 22 when the first body 22 is coupled to the mounting beam 1. That is, the first body 22 will rotate about the distal end of the first flange first portion 5. In the configuration described above, the elongated first body cantilever mounting lower member 36 engages the lower surface of the first flange 3 and resists rotation about the distal end of the first flange first portion 5. The first body support surface 32 may be disposed over the first body cantilever mounting upper member 34.

Figure 6:
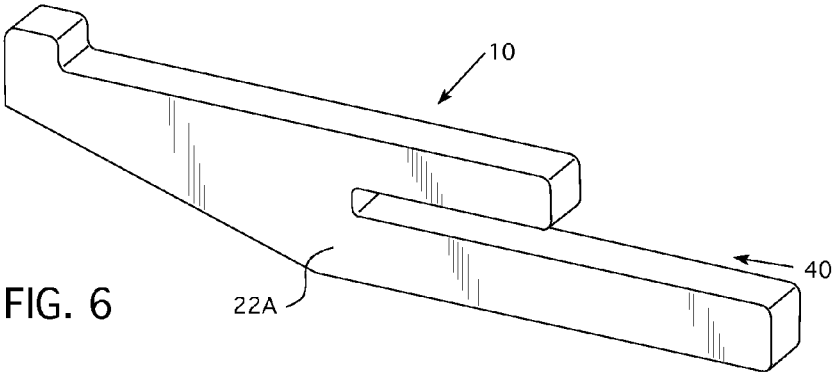
FIG. 6 is an isometric view of another embodiment of the support device vertical orientation device.

As noted above, in the embodiments disclosed in FIGS. 3 and 4, the first body 22 is made from a thin metal. Such a metal first body 22 may rotate laterally, e.g. about a horizontal line parallel with, or aligned with, the longitudinal axis of the first body 22. To resist such rotation, the first body 22 includes a vertical orientation device 40, shown in FIGS. 4, 6 and 7. The vertical orientation device 40 is structured to maintain the first body 22 in a generally vertical orientation. In one exemplary embodiment, shown in FIG. 6, the first body 22 is a "thick" first body 22A. As used herein, a "thick" first body 22A has a lateral thickness, e.g. a width in a direction generally perpendicular to the first body 22 longitudinal axis, about the same as the thickness of the first flange first portion 5.

Figure 7:
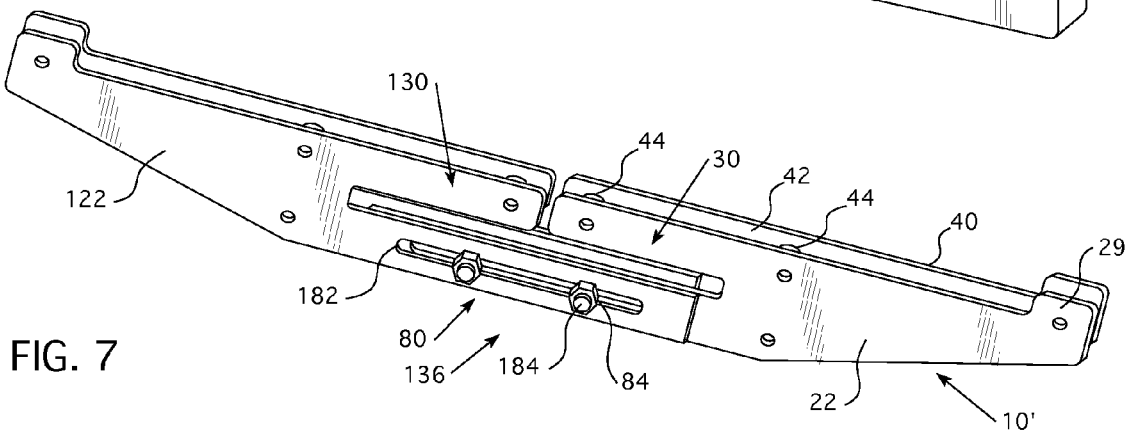
FIG. 7 is an isometric view of another embodiment of the support device with a vertical orientation device.

In another exemplary embodiment, shown in FIG. 7, the vertical orientation device 40 includes a first lateral mirror body 42 disposed in a spaced relationship with the first body 22. The lateral mirror body 42 has substantially the same dimensions as the first body 22. The lateral mirror body 42 is disposed in a spaced relationship with the first body 22. That is, in an exemplary embodiment, the lateral mirror body 42 is coupled to the first body 22 by a number of spacers 44.

In another exemplary embodiment, shown in FIG. 4, the vertical orientation device 40 includes a number of lateral support members 50. The lateral support members 50 are disposed at the first cantilever mounting slot 38 and extend generally perpendicular to the longitudinal axis of the first body 22. As shown, in an exemplary embodiment, the lateral support members 50 are tabs 52 disposed on a lower surface 35 of the first body cantilever mounting upper member 34. The tabs 52 may extend in alternating directions. The tabs 52 may be unitary with first body cantilever mounting upper member 34. Further, the tabs 52 may be resilient. That is, the tabs 52 may cause the first cantilever mounting slot 38, as defined between the tabs 52 and the first body cantilever mounting lower member 36, to be slightly more narrow than the first flange first portion 5. When the first body 22 is installed on a first flange first portion 5, the tabs 52 are flexed away from the first body cantilever mounting lower member 36, thereby engaging the first flange first portion 5.

When the mounting beam 1 includes two flange portions, e.g. first flange first portion 5 and first flange second portion 7, on opposing sides of web 2, the support assembly 20 may include a locking, second body 122. The second body 122 is coupled to the first body 22 and locks the first and second bodies 22, 122 to the mounting beam 1. In this embodiment, the first body 22 includes a first coupling assembly 80. The first body coupling assembly 80 includes a opening 82 and a first fastener component 84. As shown, the opening 82 is, in an exemplary embodiment, an elongated generally horizontal slot 86 disposed on the first body cantilever mounting lower member 36. In another exemplary embodiment, not shown, the first body coupling assembly 80 includes a number of spaced, generally circular openings. The first fastener component 84 is structured to be coupled to a second fastener component 184. The first and second fastener components 84, 184 may be, but are not limited to, a nut and a bolt.

In one embodiment, shown in FIGS. 1 and 7, wherein a user desires to have a support device on both sides of the mounting beam 1, the second body 122 is substantially similar to the first body 22. The second body 122 will not be described in detail, but it is understood that the second body 122 includes all of the components and features described above in reference to the first body 22. In the Figures, the second body 122 and its components and features are identified by reference numbers similar to the first body 22, but increased by "100." Further, in the claims, the adjective "first" is replaced with the adjective "second." For example, whereas the first body 22 includes a first body cantilever mounting 30 and a first opening 82, the second body 122 includes a second body cantilever mounting 130 and a second opening 182. It is understood that this convention applies to all components and features described above in reference to the first body 22 and that such reference numbers are used in the figures even if a specific reference number is not mentioned in this text.

In this configuration, the first and second bodies 22, 122 may be locked about the mounting beam 1. That is, as shown in FIG. 1, the first body 22 is coupled to the first flange first portion 5 and the second body 122 is coupled to the first flange second portion 7. That is, first flange first portion 5 is disposed in the first body cantilever mounting 30 and the first flange second portion 7 is disposed in the second body cantilever mounting 130. As described above, the first body cantilever mounting lower member 36 is, in an exemplary embodiment, longer than the first body cantilever mounting upper member 34. Further, the first body cantilever mounting lower member 36 has a length greater than the length of the first flange first portion 5, i.e. the length from the web 2 to the first flange first portion 5 distal end away from the web 2. In this configuration, i.e. when the first and second bodies 22, 122 are disposed on opposing flange portions 5, 7, the first body cantilever mounting lower member 36 and the second body cantilever mounting lower member 136 overlap. Thus, the first body opening 82 and the second body opening 182 overlap. In this configuration, the first fastener component 84 and the second fastener component 184 may be passed through the first body and second body openings 82, 182 and tightened, thereby locking the first and second bodies 22, 122 together as well as locking the first and second bodies 22, 122 about the mounting beam 1.

Figure 8:
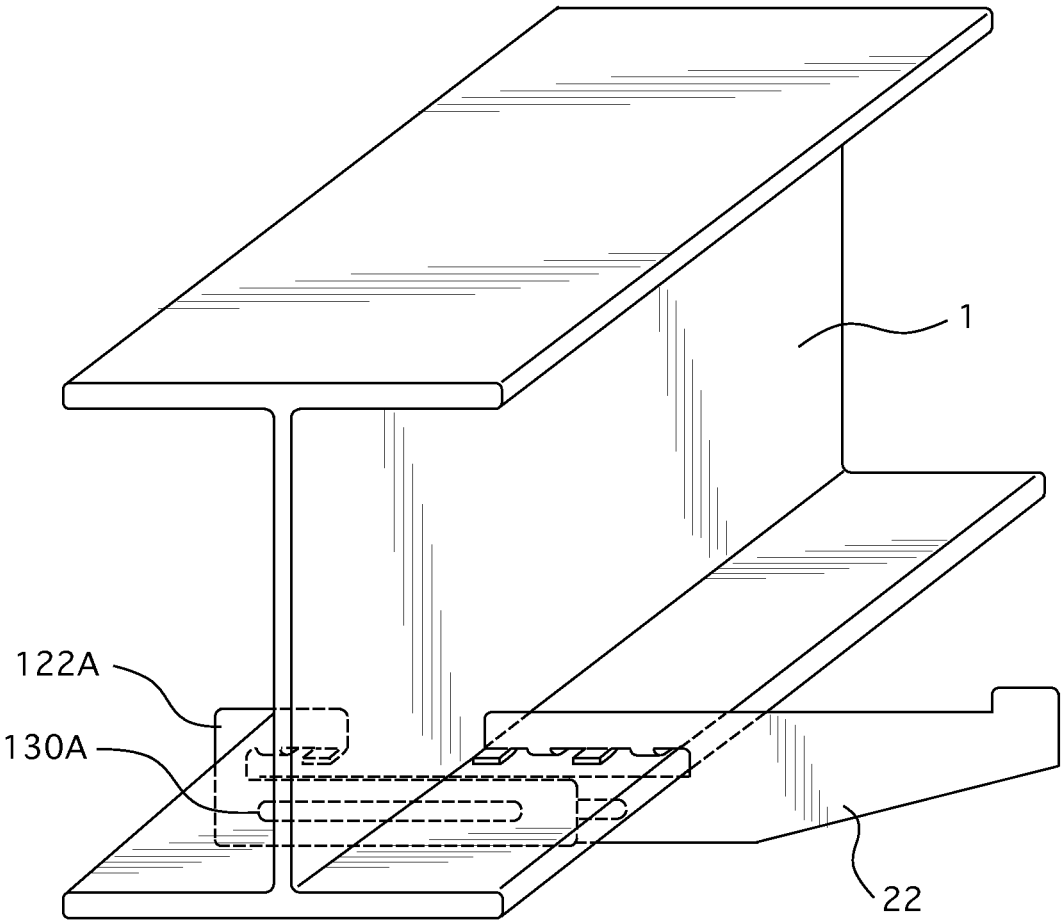
FIG. 8 is an isometric view of another embodiment of the support device.

In another embodiment, shown in FIG. 8, the second body 122A is not substantially similar to the first body 22. That is, the mounting beam 1 may be disposed adjacent to an obstruction or a wall and the user may not be able to utilize the second side of the mounting beam 1 for storage. In this embodiment, the second body 122A includes a cantilever mounting 130A but does not include a support surface. In other respects, the alternate second body 122A is similar to the second body 122 described above and may be coupled to the first body 22 as described above.

Figure 5:
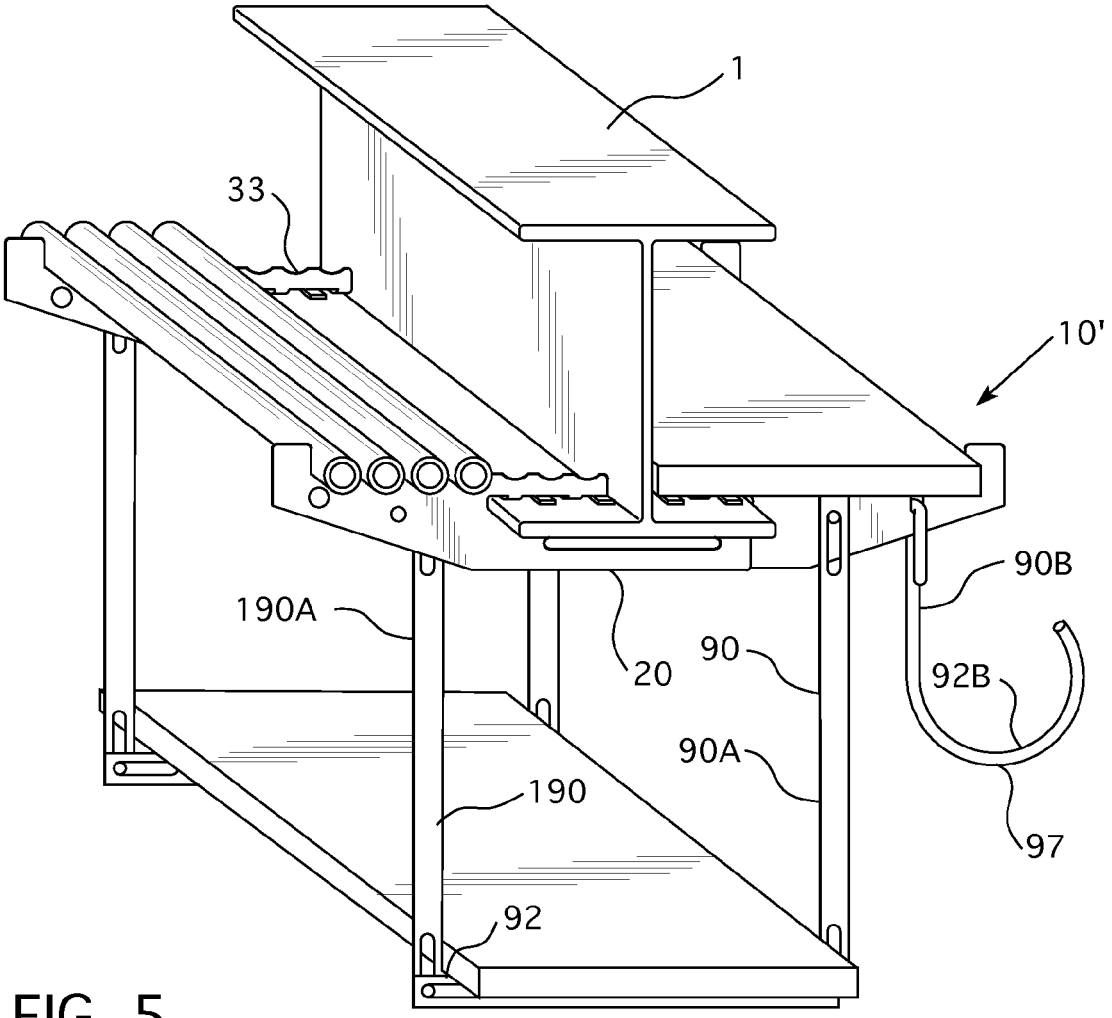
FIG. 5 is an isometric view of another embodiment of the support device coupled to a mounting beam having an I-shaped cross-section.
Figure 9:
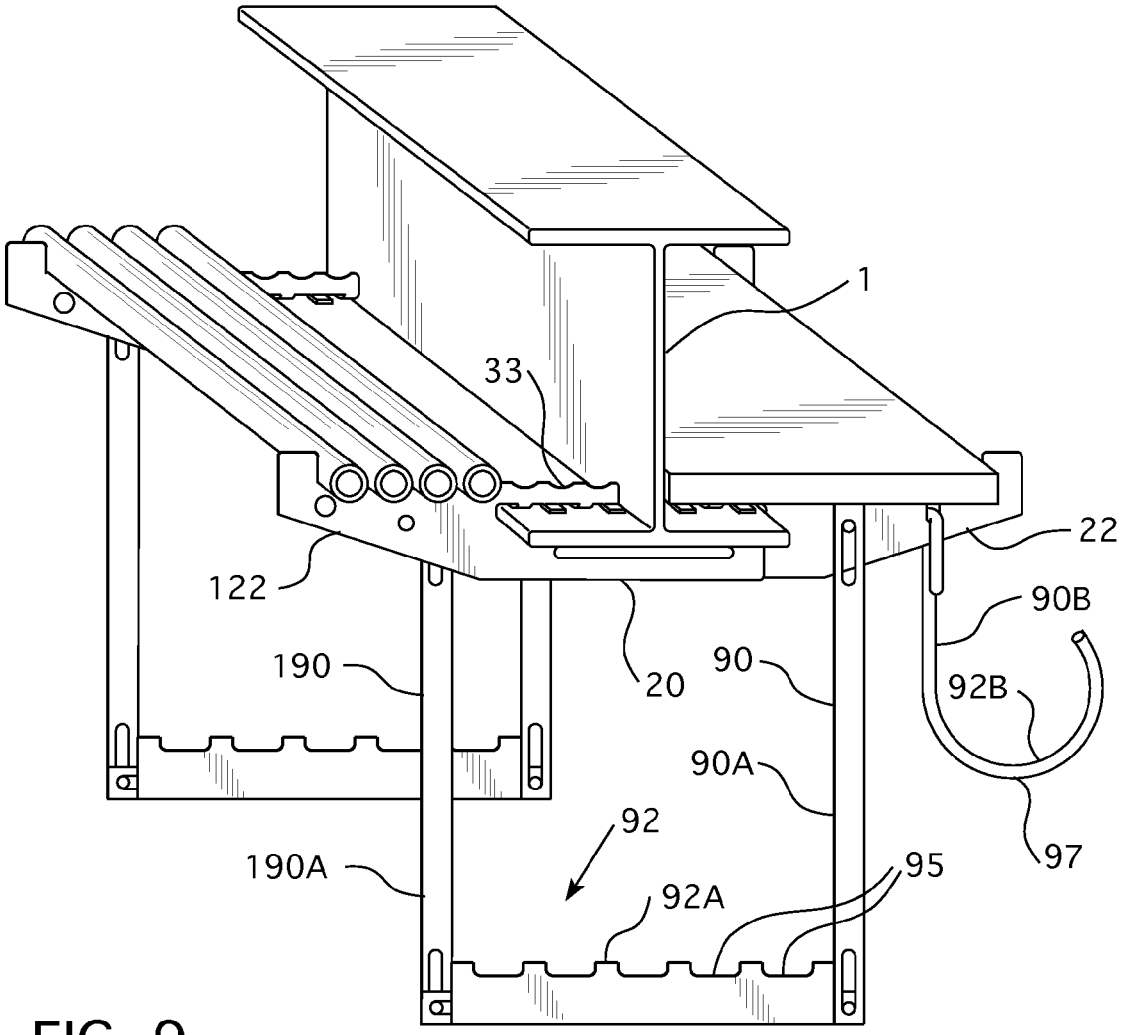
FIG. 9 is an isometric view of a support device with a vertical extension.
Figure 10:
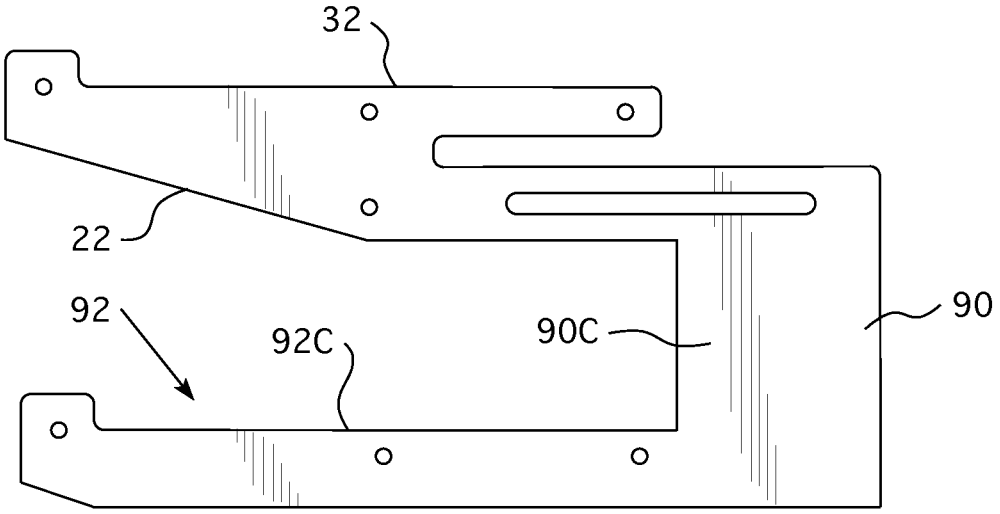
FIG. 10 is an isometric view of a support device with another embodiment of the vertical extension.

As shown in FIGS. 5, 9 and 10, the first body 22, as well as the second body 122, may include a vertical extension 90, or for the second body, vertical extension 190 and a number of lower support surfaces 92. The first body vertical extension 90 extends generally vertically and downwardly from the first body cantilever mounting 30. FIGS. 5, 9 and 10 show various configurations of vertical extensions 90 and lower support surfaces 92. For example, FIG. 5 shows a first body vertical extension 90A that is a generally straight member. In this embodiment, the lower support surface 92A is a generally horizontal member that is further coupled the second body vertical extension 190A. In this configuration, the lower support surface 92A may support a shelf 9. In a similar but alternate embodiment, shown in FIG. 9, the lower support surface 92A includes a number of contoured recesses 95. Also shown in FIG. 5 is an embodiment wherein a first body vertical extension 90B is a generally straight member and a lower support surface 92B is an arcuate member 97. As shown in FIG. 10, the first body vertical extension 90C may be a planar member and the lower support surfaces 92C may be similar to the first body support surface 32.

Further, the support device 10 may include a mounting assembly 200. The mounting assembly 200 includes a cantilever member 202. In the exemplary embodiment shown in FIG. 11, the cantilever member 202 is included in a mounting bracket 204. The mounting bracket 204 is structured to be coupled to, and in one embodiment directly coupled to, a generally vertical surface. As shown in FIG. 12, the mounting bracket 204 includes the cantilever member 202, a base 206, a lower brace 208 and an upper brace 210. Both the lower and upper braces 208, 210 are coupled at one end to the base 206. The lower brace 208 may include a coupling assembly 212 such as, but not limited to, a fastener component 214 (as shown a threaded opening).

Figure 11:
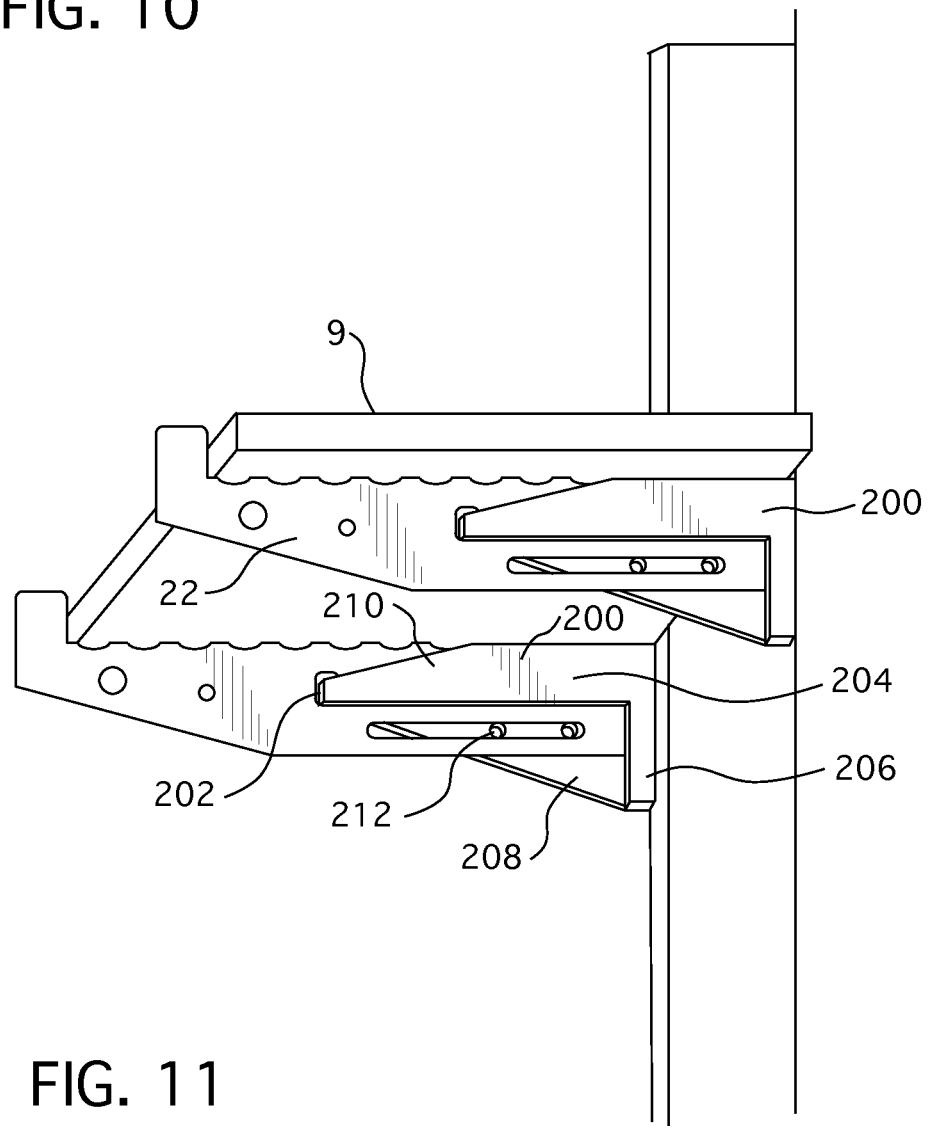
FIG. 11 is an isometric view of one embodiment of a mounting assembly.
Figure 12:
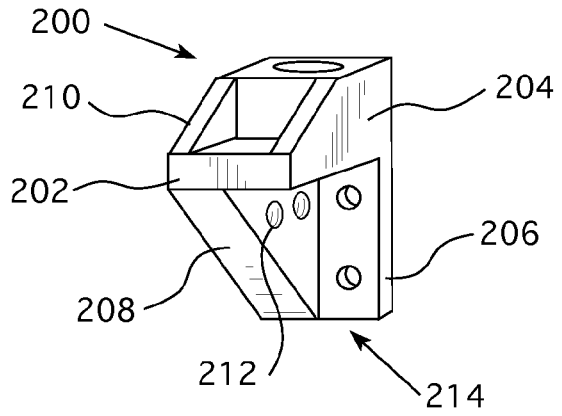
FIG. 12 is a detail isometric view of the mounting assembly shown in FIG. 11.

When assembled, as shown in FIG. 11, the first body 22 is coupled to the mounting bracket 204 by disposing the cantilever member 202 in the first body cantilever mounting 30. The first body 22 may be secured to the mounting bracket 204 by a fastener (not shown) that passes through the first body first opening 82 and into the coupling assembly 212.

Figure 13:
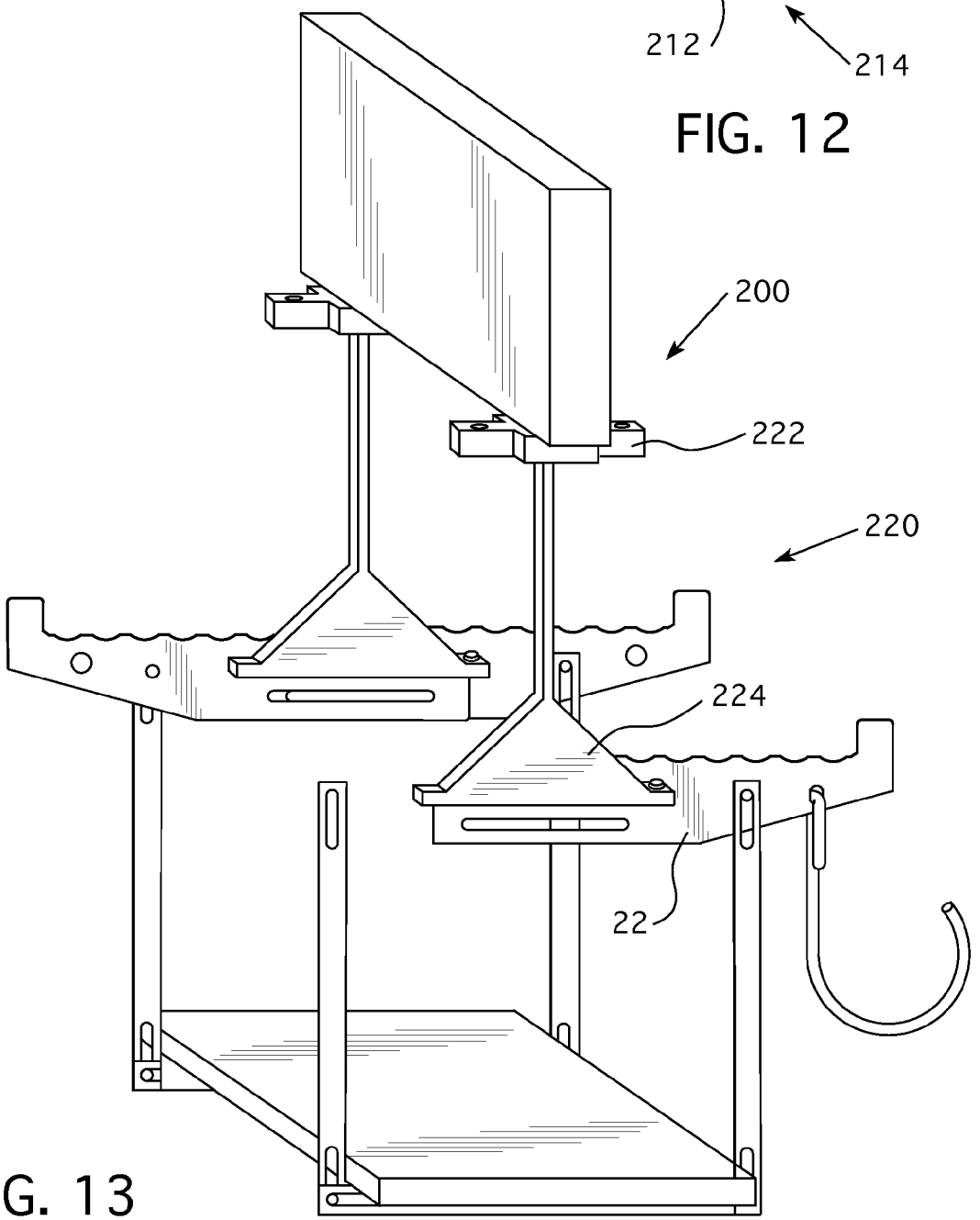
FIG. 13 is an isometric view of another embodiment of a mounting assembly.

In another embodiment, shown in FIG. 13, the mounting assembly 200 includes a ceiling mount 220. The ceiling mount 220 includes an upper coupling 222 and a lower mount 224. The upper coupling 222 is, in an exemplary embodiment, "+" shaped. In this configuration, the upper coupling 222 may be attached to ceiling beams that extend generally perpendicular or parallel to the lower mount 224.

Figure 14:
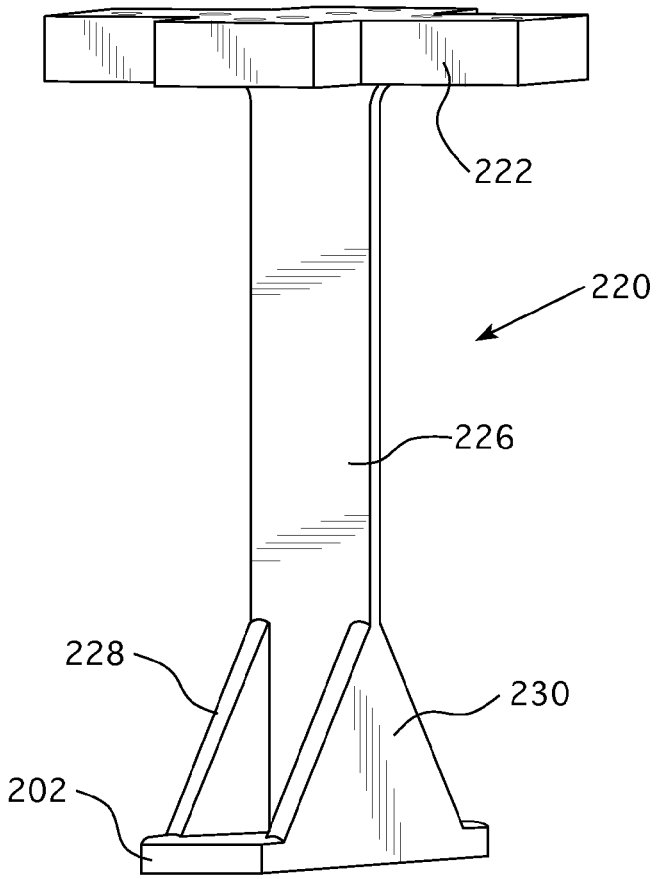
FIG. 14 is a detail isometric view of the mounting assembly shown in FIG. 13.

As shown in FIG. 14, the lower mount 224 includes a cantilever member 202, a vertical member 226, a first lateral brace 228 and a second lateral brace 230. The cantilever member 202 is a planar member that is disposed generally horizontally. The vertical member 226 extends between the upper coupling 222 and the cantilever member 202. The first lateral brace 228 and the second lateral brace 230 are disposed on either side of the cantilever member 202. The first lateral brace 228 and the second lateral brace 230 are coupled to, and in one embodiment directly coupled to, both the cantilever member 202 and the vertical member 226. As shown, the first lateral brace 228 and the second lateral brace 230 are generally triangular planar members.

Figure 15:
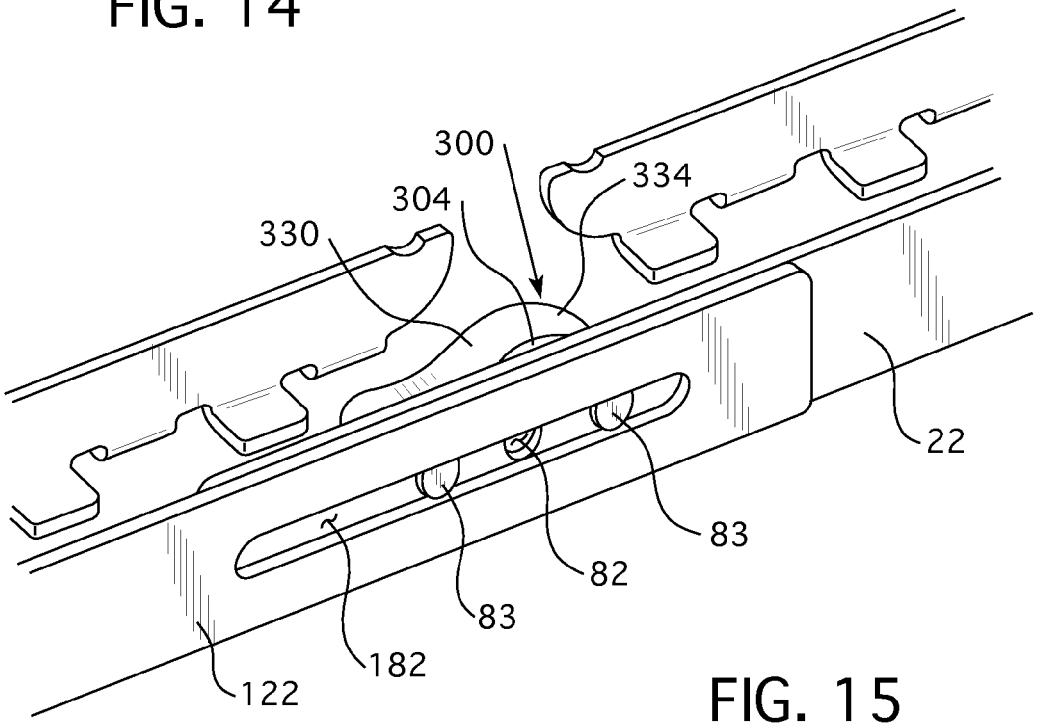
FIG. 15 is an isometric view of a support assembly with a cam assembly.
Figure 18:
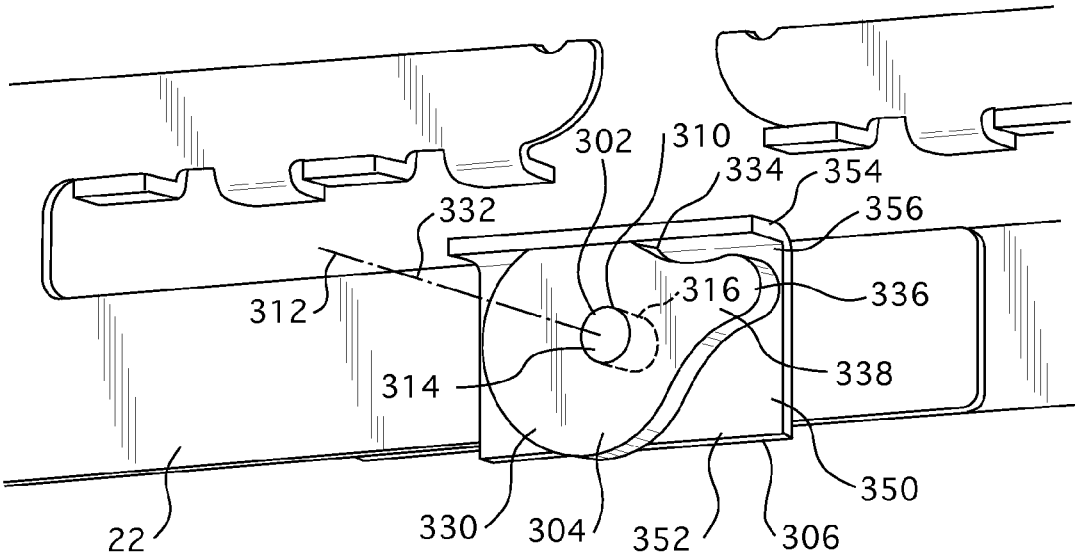
FIG. 18 is a detail isometric view of a cam assembly.
Figure 19:
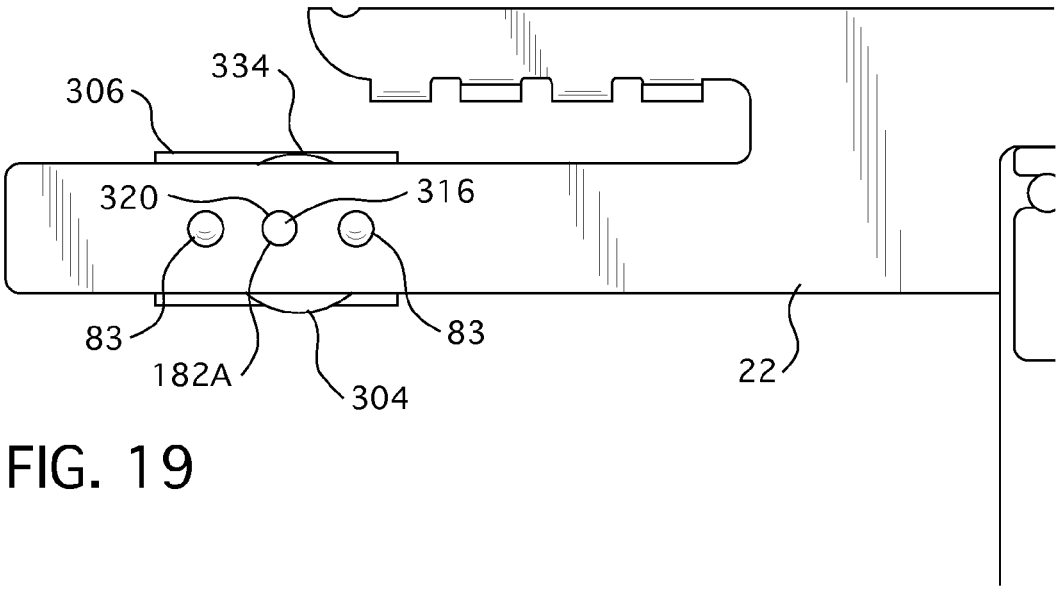
FIG. 19 is a back side view of a cam assembly.

Further, as shown in FIG. 15, the cantilever mounting 30, in an exemplary embodiment, includes a cam assembly 300. As shown in FIGS. 18-19, the cam assembly includes an axle 302, a cam member 304 and, in an exemplary embodiment, a bracket 306. The axle 302 includes a substantially cylindrical body 310 having an axis of rotation 312. The axle 302 includes a first end 314 and a second end 316. The axle second end 316, in an exemplary embodiment, includes a coupling 320 such as, but not limited to, a threaded portion (not shown) to which a nut (not shown) may be coupled. The axle 302 is disposed, or rotatably disposed, in the first body opening 82 and, the second body opening 182 if the openings 82, 182 overlap. In an exemplary embodiment, shown in FIG. 19, first body 22 includes a generally circular opening 182A. Further, first body 22 includes dimples 83 that extend toward second body 122. Second body 122 includes an elongated opening 82. As shown in FIG. 15, when the first and second bodies 22, 122 are disposed adjacent to each other, dimples 83 extend toward, and are disposed in, elongated opening 182.

As shown in FIG. 15, the cam member 304 includes a disk-like body, i.e. a "spiral body" 330, wherein a portion thereof includes a variable radius. That is, as used herein, such a body is identified as a "spiral body." The spiral body 330 includes an axis of rotation 332. In an alternate embodiment, not shown, and as used herein, the "spiral body" also includes a generally circular body wherein the axis of rotation is radially offset from the center of the circular body. The radial face of the portion of the spiral body 330 with a variable radius is a cam surface 334. That is, as is known, the variable radius increases gradually over an arc. In the embodiment with a generally circular disk, not shown, the radial surface is the cam surface 334. The spiral body 330 further includes an actuator 336, as shown in FIG. 16.

The cam body actuator 336, in an exemplary embodiment as shown, is a handle 338 extending generally radially from the spiral body 330. That is, the cam body actuator 336 is unitary with the spiral body 330 and extends generally radially therefrom. The cam body actuator 336, in an exemplary embodiment, extends generally radially relative to the spiral body axis of rotation 332. In another exemplary embodiment, not shown, the cam body actuator 336 is a hexagonal lug, similar to a nut, extending from the spiral body 330 and disposed about the spiral body axis of rotation 332.

In one embodiment, the cam member 304 directly engages mounting beam 1 (FIG. 15). In this embodiment, the radius of the spiral body 330 at the cam surface 334 generally corresponds to the length between first body opening 82 and first cantilever mounting slot 38. It is understood that the radius of the spiral body 330 at the cam surface 334 is variable and that, as such, rotation of the spiral body 330 causes the cam surface 334 to move toward (and then engage the mounting beam 1) or away from the mounting beam 1.

Figure 16:
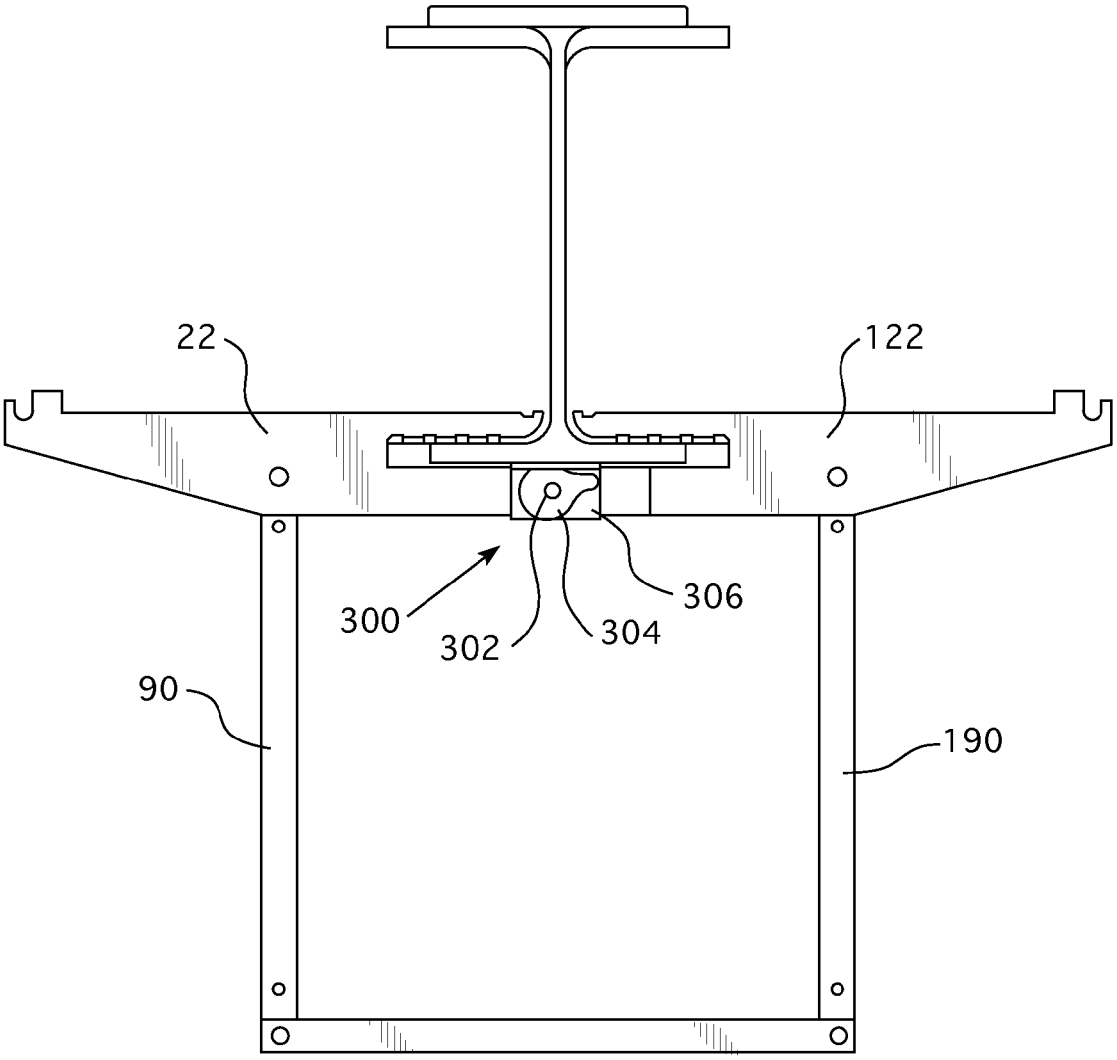
FIG. 16 is a front view of another support assembly with a cam assembly.
Figure 17:
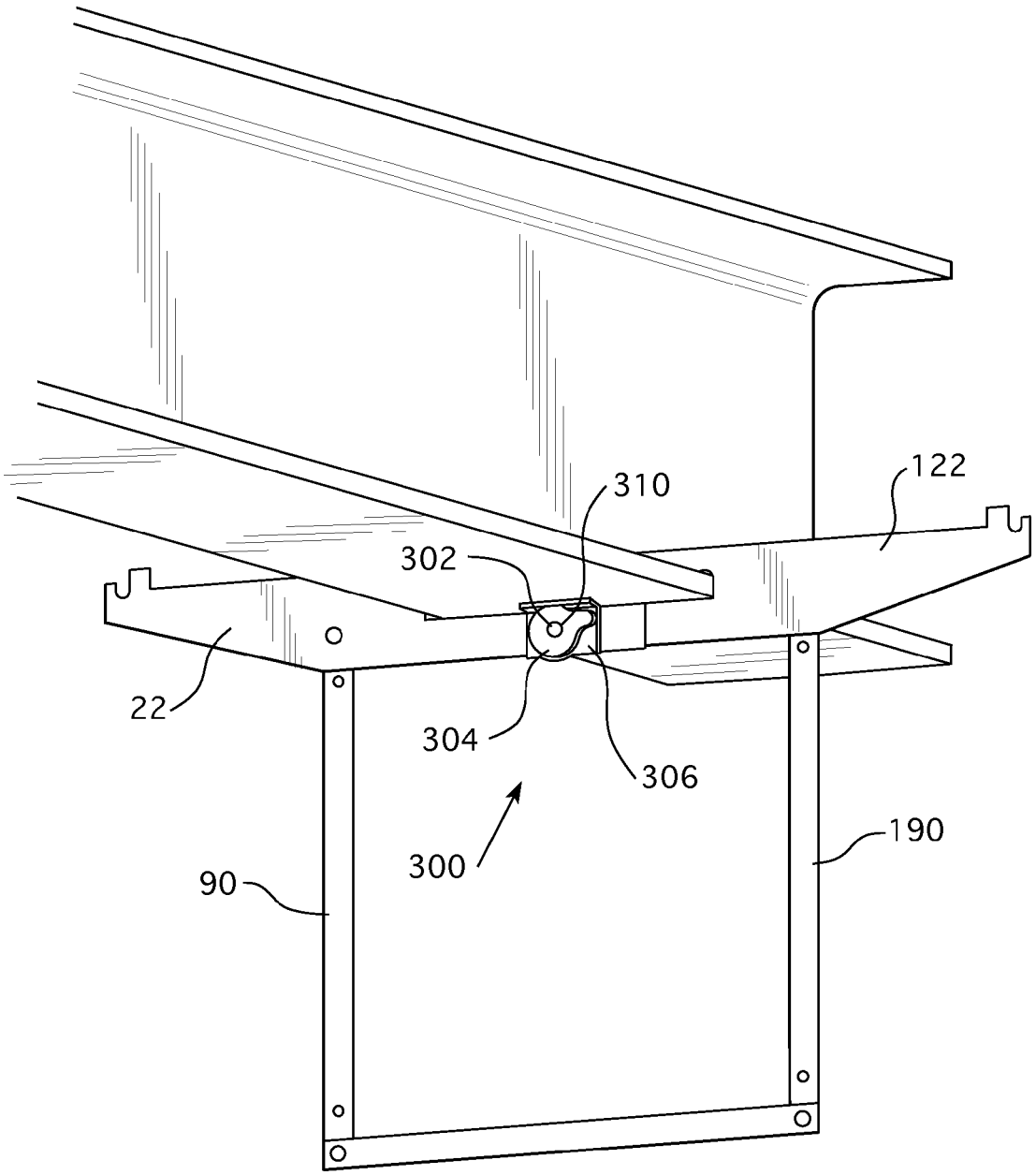
FIG. 17 is an isometric view of a support assembly with a cam assembly.
Figure 20:
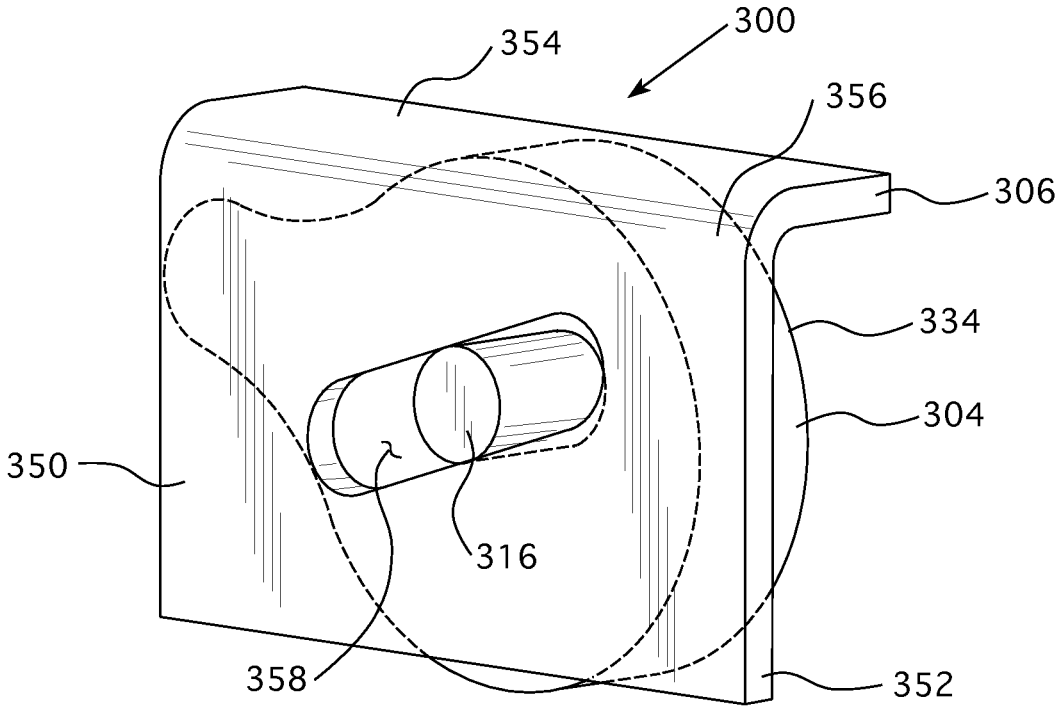
FIG. 20 is detail isometric back side view of a cam assembly.
Figure 21:
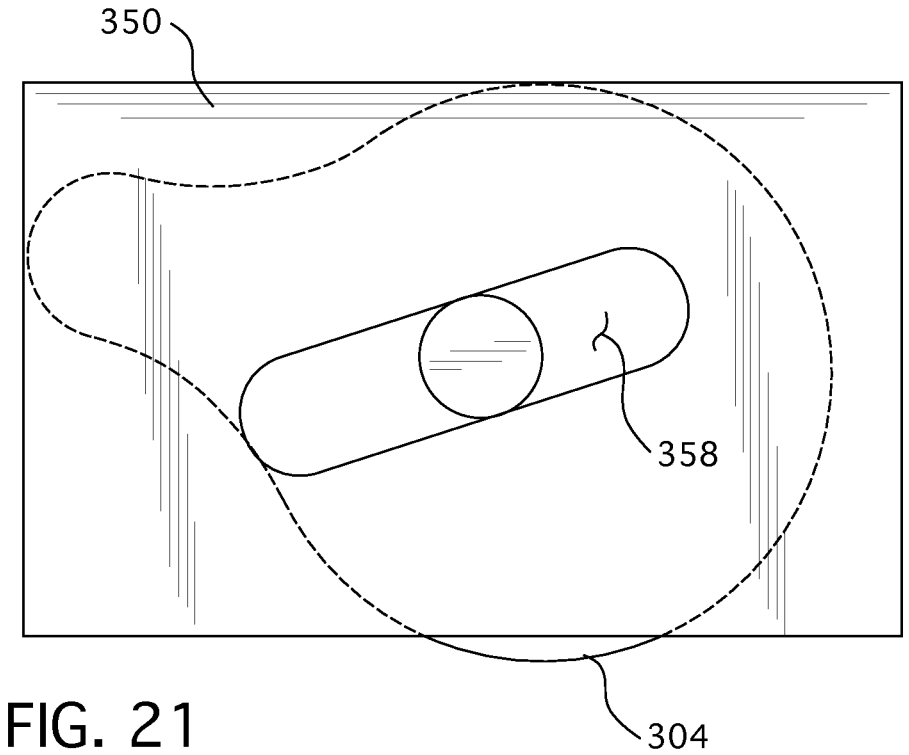
FIG. 21 is another detail back side view of a cam assembly.

In another embodiment, shown in FIG. 16, the cam assembly 300 includes a cam assembly bracket 306. In this embodiment, the radius of the spiral body 330 at the cam surface 334 is slightly less than the length between first body opening 82 and first cantilever mounting slot 38. That is, the cam assembly bracket 306 includes, in an exemplary embodiment, an L-shaped body 350. That is, the assembly bracket body 350 includes a first generally planar member 352 and a second generally planar member 354. The cam assembly bracket planar members 352, 354 intersect at an interface line 356 extending in a first direction. In an exemplary embodiment, the cam assembly bracket planar members 352, 354 are disposed, generally, at a right angle. As shown in FIGS. 20-21, the cam assembly bracket first generally planar member 352 includes a slot 358. The cam assembly bracket slot 358 extends at an angle relative to the interface line 356.

The cam assembly 300 is assembled as follows. The axle 302 is disposed, or rotatably disposed, in the second body opening 182A. If a cam assembly bracket 306 is to be used, the cam assembly bracket 306 is then disposed adjacent the body cantilever mounting lower member 36 with the axle 302 extending through the cam assembly bracket slot 358. The cam assembly bracket second planar member 354 is disposed adjacent to, and in an exemplary embodiment abutting, the lower surface of I-beam first flange 3. The spiral body 330 is coupled, rotatable coupled, directly coupled, or fixed (if the axle 302 rotates), to the axle 302. In an exemplary embodiment, wherein the spiral body 330 has a variable radius, the axle axis of rotation 312 and the spiral body axis of rotation 332 are substantially aligned.

In this configuration, the cam surface 334 contacts, or engages, the lower surface of cam assembly bracket second planar member 354. As the spiral body 330 is rotated in a selected direction, the cam surface 334 engages the cam assembly bracket 306 which in turn engages the lower surface of I-beam flange 3. The counter bias created thereby draws the first and second bodies 22, 122 into engagement with the mounting beam 1.

Figure 22:
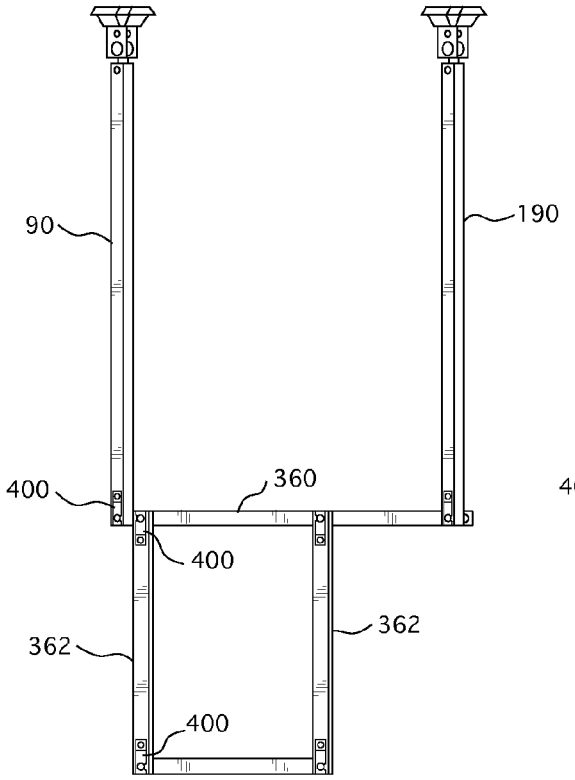
FIG. 22 is an isometric view of a support assembly with latching coupling assemblies.
Figure 23:
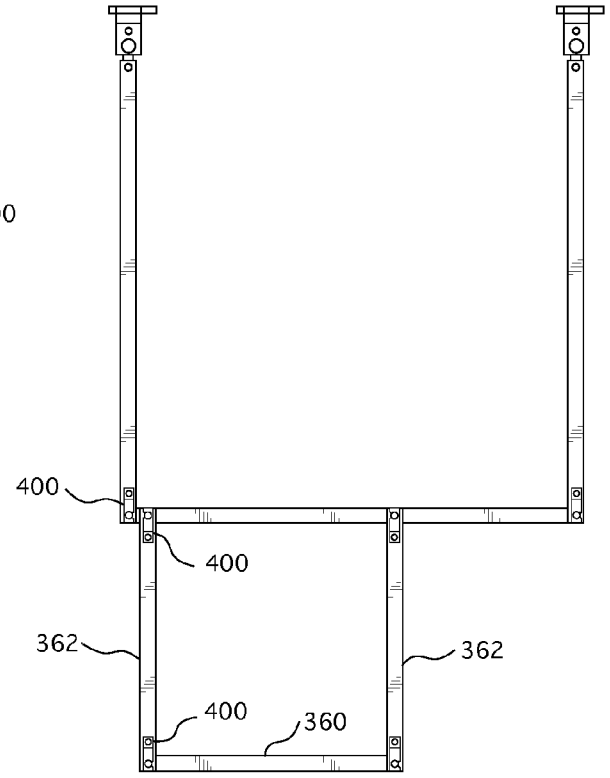
FIG. 23 is a front view of a support assembly with latching coupling assemblies.
Figure 24:
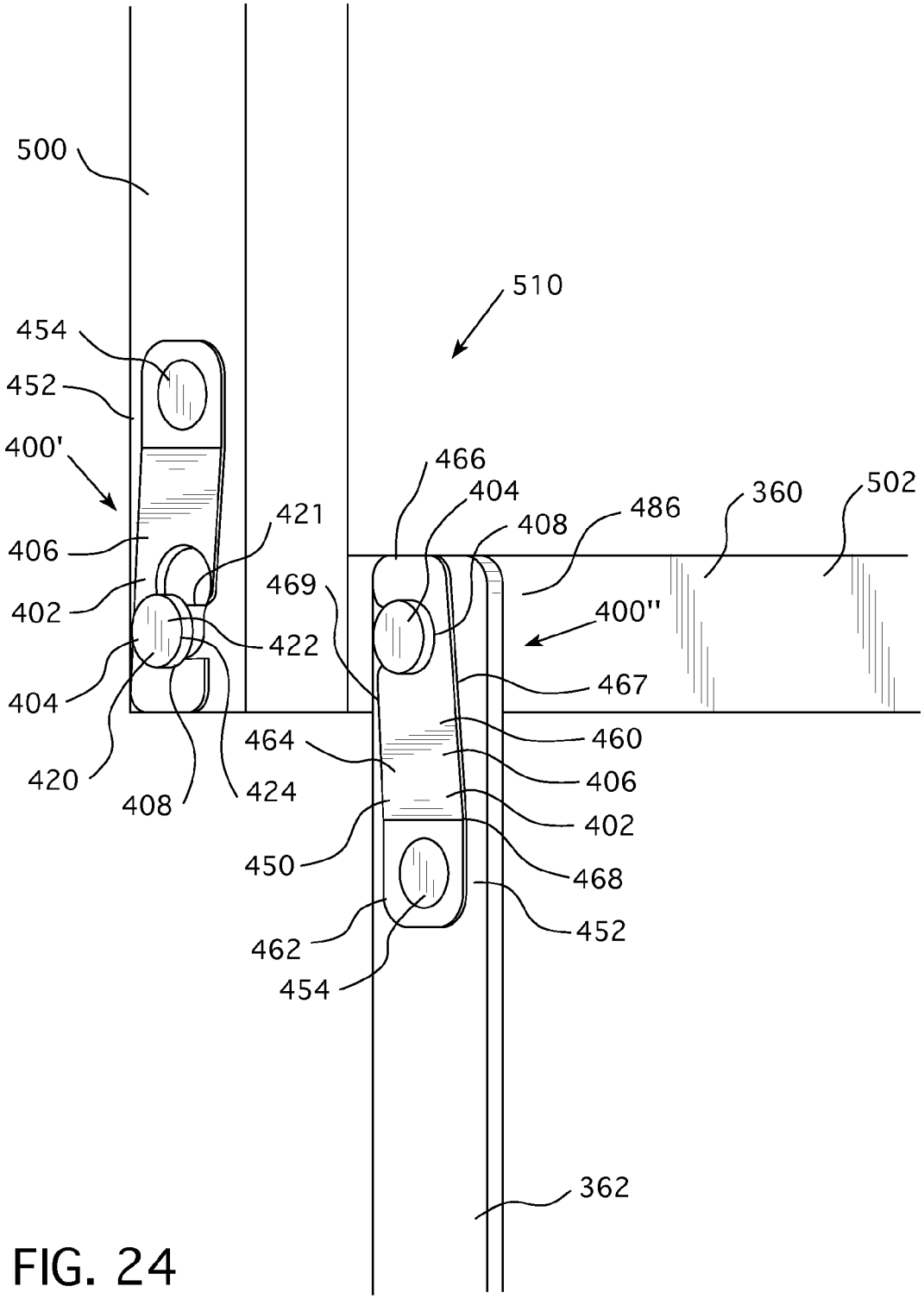
FIG. 24 is a detail isometric view of a support assembly with latching coupling assemblies.

Members of the support device 10, such as, but not limited to vertical extensions 90, 190 may be unitary with the first and second bodies 22, 122, or may be separate elements, as shown in FIGS. 22-23. In an exemplary embodiment, the vertical extensions 90, 190, as well as a number of horizontal members 360 (which include or define the lower support surfaces 92) are coupled to each other and to the first and second bodies 22, 122 by a latching coupling assembly 400. As shown in FIG. 24, a latching coupling assembly 400 includes a first coupling component 402 and a second coupling component 404. The first coupling component 402 includes a biasing construct 406. As used herein, a "construct" is a unitary body or an assembly of components. The second coupling component 404 includes an engagement construct 408. The first coupling component 402 is coupled to the second coupling component 404 with the biasing construct 406 engaging the engagement construct 408.

Figure 25:
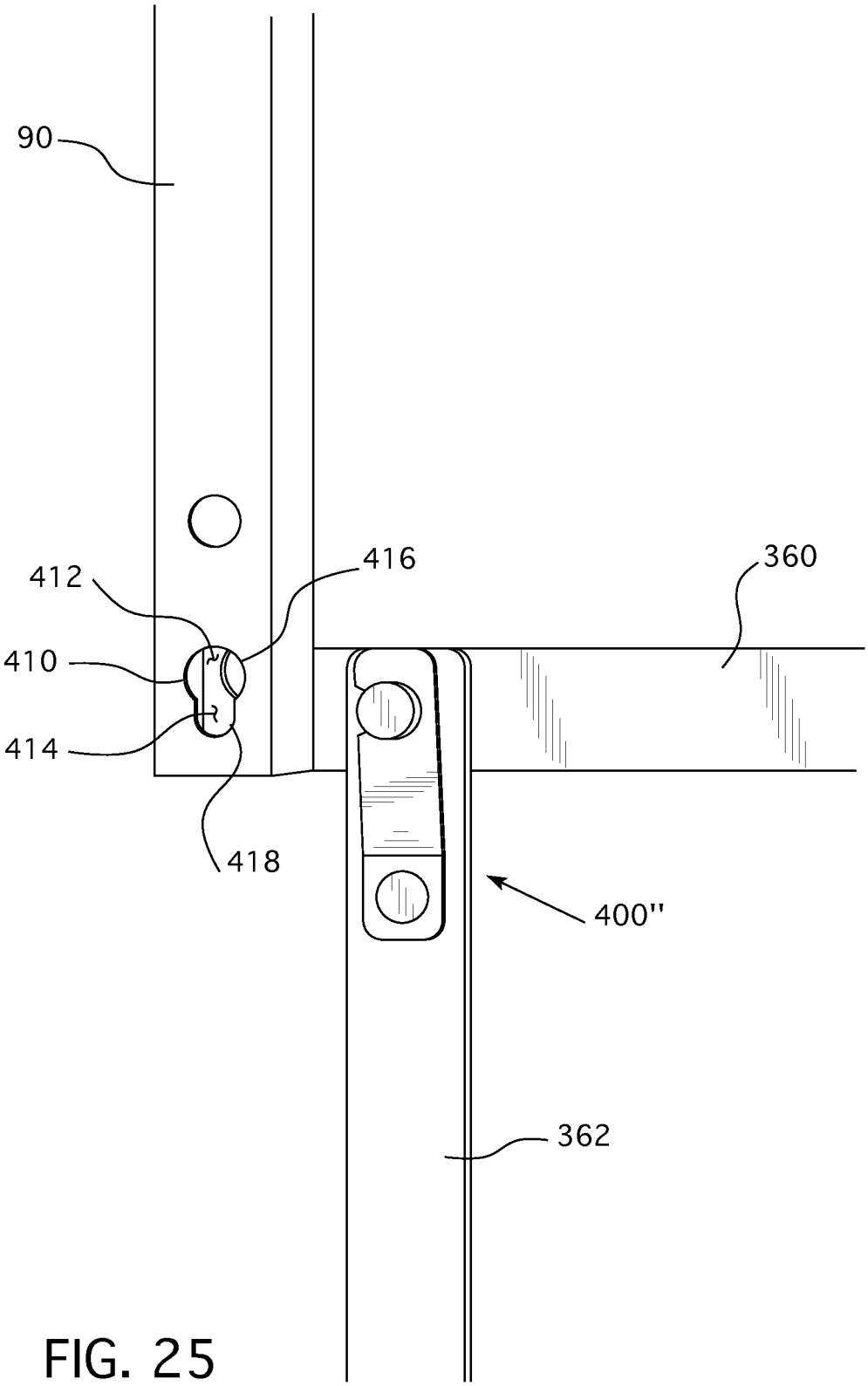
FIG. 25 is a detail isometric view of a latching coupling assemblies with selected elements removed.

In an exemplary embodiment, and as shown in FIG. 25, the first coupling component 402 includes a keyed opening 410. As used herein, a "keyed opening" is an opening including a wide portion 412 and a narrow portion 414; in an exemplary embodiment, the wide portion 412 is a generally circular opening 416 with a first diameter and the narrow portion is a radial slot 418 extending from the circular opening 416 and wherein the width of the slot 418 is less than the first diameter. Further, in an exemplary embodiment and as shown in FIG. 24, the second coupling component 404 is a flanged pin 420. As used herein, a "flanged pin" includes an elongated body 421 with a generally radial flange 422 extending therefrom; in an exemplary embodiment, the flange 422 is a pin head 424 such as, but not limited to, a generally planar, or "flat," pin head 424. The flanged pin body 421 has first cross-sectional area. The pin head 424 has a second cross-sectional area that is larger than the first cross-sectional area. The pin head 424 is shaped to correspond to the keyed opening wide portion 412, but with a slightly smaller cross-sectional area. The pin head 424 has a greater cross-sectional area than the slot 418. The flanged pin body 421 has cross-sectional area that is slightly smaller than the slot 418. In an exemplary embodiment, the flanged pin body 421 and the pin head 424 have a generally circular cross-sectional shape.

A first latching coupling assembly 400' is structured to couple vertical extension 90 and horizontal member 360. The first coupling component 402, i.e. the keyed opening 410, is disposed on a first member, as shown vertical extension 90, and the second coupling component 404 is disposed on a second member, as shown horizontal member 360, that are to be coupled. As shown, vertical extension 90 has a square cross-section and flanged pin 420 has a sufficient length to extend therethrough. That is, the length of pin body 421 is about the same as, or slightly longer than, the cross-sectional width of vertical extension 90. As also shown, a second latching coupling assembly 400" is structured to couple horizontal member 360 and a vertical member 362. In the second latching coupling assembly 400, the vertical member 362 is generally planar and first coupling component 402, i.e. the keyed opening 410, is disposed thereon. Further, in the second latching coupling assembly 400, the second coupling component 404, i.e. flanged pin 420, is disposed on the horizontal member 360 and has a sufficient length to extend therethrough. That is, the length of this pin body 421 is about the same as, or slightly longer than, the width of generally planar vertical member 362.

Figure 26:
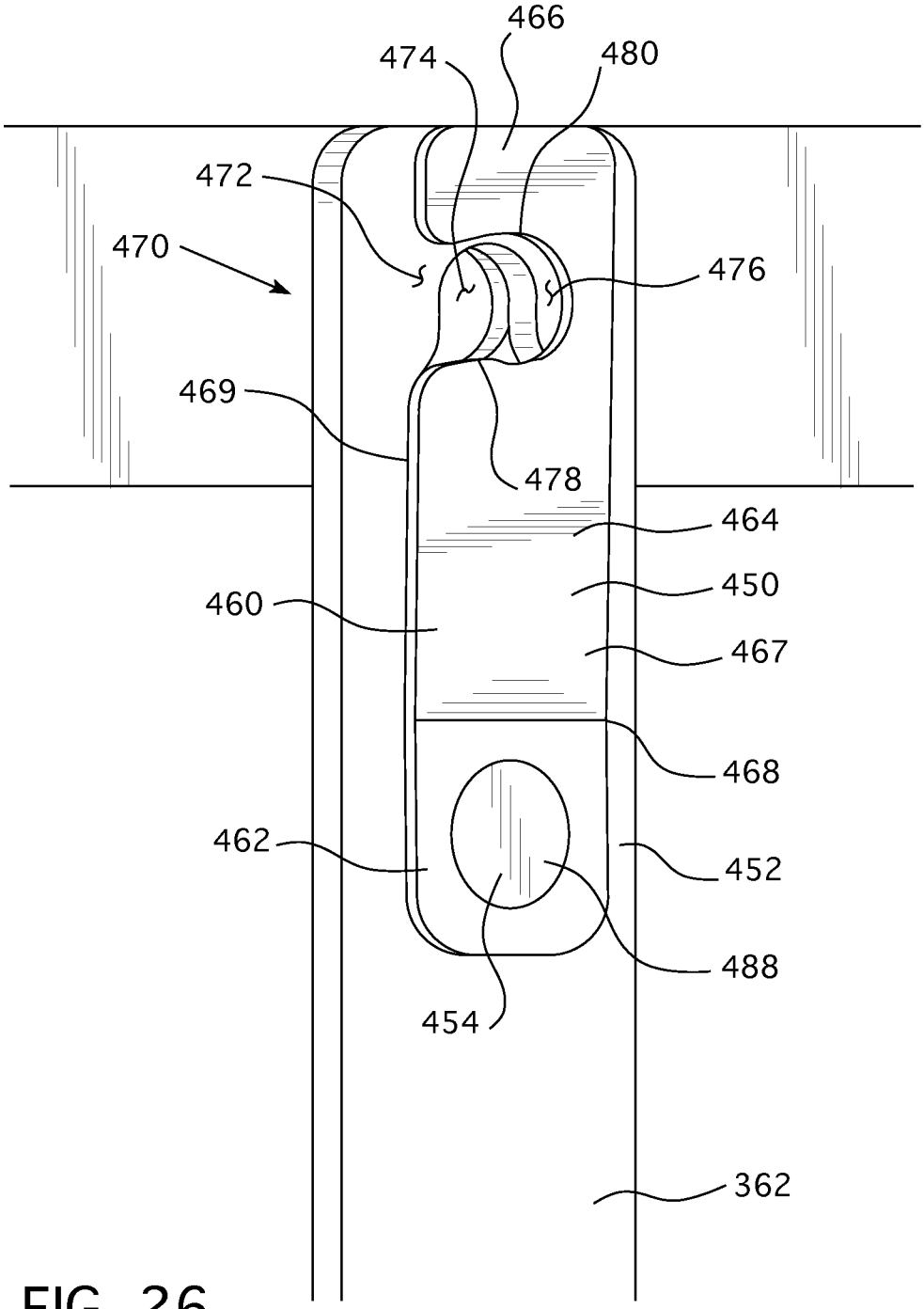
FIG. 26 is another detail isometric view of a latching coupling assembly with selected elements removed.
Figure 27:
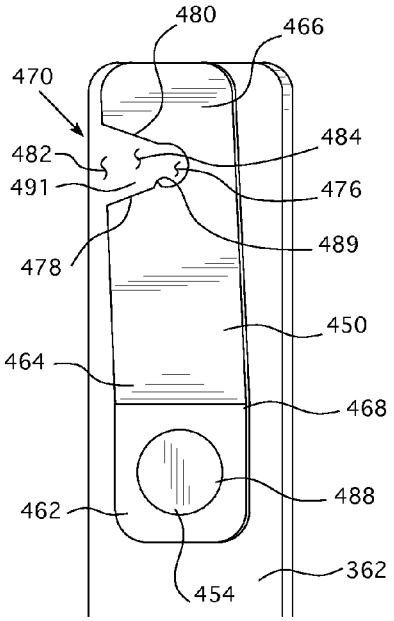
FIG. 27 is a detail front view of an alternate latching coupling assembly with selected elements removed.

In an exemplary embodiment, the biasing construct 406 includes a number of leaf springs 450, a leaf spring mounting 452 and a leaf spring coupling 454. In one embodiment, shown in FIG. 26, the biasing construct 406 includes a single leaf spring 450. Each leaf spring 450 includes a resilient, generally planar, elongated body 460 with a first end 462, medial portion 464, a second end 466, a first lateral side 467 and a second lateral side 469. The leaf spring body medial portion 464 includes a bend 468. Further, in an exemplary embodiment, the leaf spring second end 466 includes a cutout 470. The cutout 470 includes an opening 472, a passage 474, and a terminus 476. The cutout opening 472 is disposed on one of the lateral sides 467, 469. The cutout passage 474 includes two opposing sides 478, 480. In an exemplary embodiment, the cutout passage sides 478, 480 are generally parallel and are spaced apart by a distance corresponding to the cross-sectional width of the flanged pin body 421. In another exemplary embodiment, one or both cutout passage sides 478, 480 taper from a wide cutout opening 472 to a narrow cutout terminus 476. That is, as shown in FIG. 27, the cutout passage 474 includes a wide portion 482, disposed adjacent said cutout opening 472, and a narrow portion 484, disposed adjacent said cutout terminus 476. The cutout terminus 476 has a cross-sectional width corresponding to the flanged pin body 421, i.e. the first cross-sectional area. In an exemplary embodiment, the cutout 470 includes a restraining device 489. The restraining device 489 is structured to resist movement of the flanged pin body 421 through the cutout passage 474. The restraining device 480, in an exemplary embodiment, is a rounded nib 491 disposed at the interface of, i.e. between, the cutout passage 474 and the cutout terminus 476. The nib 491 extends into making the cutout passage 474 slightly less wide than the first cross-sectional area. The nib 491 is, in an exemplary embodiment, unitary with the leaf spring body 460 and, as such, is resilient. Thus, when a flanged pin body 421 moves through the restraining device 489, the restraining device 489 increases resistance to movement of the flanged pin body 421, but does not prevent passage therethrough.

The leaf spring mounting 452, which is, as shown, for the first latching coupling assembly 400' a portion of horizontal member 360, includes a first engagement surface 486. The leaf spring coupling 454 is, in an exemplary embodiment, a rivet 482 coupled to an opening (not shown) in horizontal member 360. In this configuration, the leaf spring 450 is rotatable between a first position, wherein the leaf spring second end 466, and the cutout terminus 476, is not generally aligned with the keyed opening slot 418, and a second position wherein the leaf spring second end 466, and the cutout terminus 476, is generally aligned with the keyed opening slot 418.

In this configuration, the second coupling component 404, in an exemplary embodiment the flanged pin head 424, is passed through the keyed opening wide portion 412 until the flanged pin body 421 is in the keyed opening wide portion 412. The flanged pin 420 is then moved until the flanged pin body 421 is disposed in the keyed opening slot 418. The leaf spring 450 is then moved into the second position. It is noted that the angle of leaf spring bend 468 positions leaf spring second end 466 above the pin head 424. Thus, the leaf spring 450 is compressed, i.e. flattened as it is being moved. Further, as the leaf spring 450 is being moved, the flanged pin body 421 moves through the cutout 470. When the leaf spring 450 is in the second position, the flanged pin body 421 is disposed in the cutout terminus 476. Moreover, the leaf spring second end 466 is biased against the pin head 424. That is, the pin head 424 is the engagement construct 408. Thus, the leaf spring 450 is rotatable between a first position, wherein the leaf spring second end 466 does not engage the second coupling component 404, and a second position wherein the leaf spring second end 466 engages the second coupling component 404.

Figure 28:
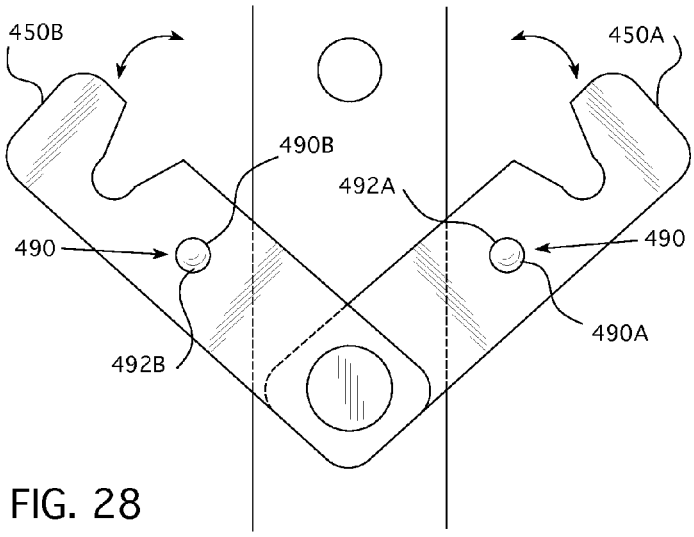
FIG. 28 is a detail front view of another alternate latching coupling assembly with selected elements removed.

In another embodiment, shown in FIG. 28, the biasing construct 406 includes two leaf springs; a first leaf spring 450A and a second leaf spring 450B. In an exemplary embodiment, the leaf springs 450A, 450B are stacked and coupled to the leaf spring mounting 452 by a single leaf spring coupling 454. In this embodiment, the cutout openings 472 on each leaf spring 450A, 450B is located on opposite cutout passage lateral sides 478, 480. Thus, the leaf springs 450A, 450B move in different directions, one clockwise the other counterclockwise, into their respective second positions. Further, in this embodiment, the second coupling component 404, in an exemplary embodiment the flanged pin body 421 is enclosed within the two leaf spring cutouts 470. Further, in this embodiment, the leaf springs 450A, 450B each include a positioning element 490, that is a first positioning element 490A and a second positioning element 490B, respectively. In an exemplary embodiment, the positioning elements 490A, 490B are each a detent 492A, 492B located in approximately the same position on each leaf spring 450A, 450B. When the leaf springs 450A, 450B are in the second position, the detent 492A on the upper leaf spring 450A is disposed in the detent 492B on the lower leaf spring 450B and resist movement of the leaf springs 450A, 450B from the second position.

Members of the support device 10, such as, but not limited to vertical extensions 90, 190 are also, broadly speaking, structural elements 500, 502 of an assembly 504. Thus, in the configuration disclosed above, the latching coupling assembly 400 joins the first element 500 and the second element 502. As shown, the first and second elements 500, 502 are elongated elements that are either generally flat, e.g. first element 500, or generally tubular, as shown a square tube. The first and second elements 500, 502, however, may be any shape including, but not limited to, cylindrical elements (not shown). The first coupling component 402 is disposed on the first element 500 and the second coupling component 404 is disposed on the second element 502. The combination of the first element 500, second element 502, first coupling component 402 and second coupling component 404 forms a "joint" 510. That is, as used herein, a "joint" is a construct wherein a number of elements are coupled by a coupling. In an exemplary embodiment, the latching coupling assembly 400 creates a bias of ten pounds of force, or less. Thus, the joint 510 is a "stiff joint."

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A support device for a generally horizontally extending mounting beam, said beam including a generally vertical web and a generally horizontal first flange having a first portion disposed one side of said web, wherein said mounting beam first flange first portion has a generally rectangular cross-section, said support device comprising:

a support assembly including an elongated first body defining a cantilever mounting and a support surface;

said first body cantilever mounting corresponding to said first flange first portion;

said first body cantilever mounting includes an upper member and a lower member;

said first body cantilever mounting upper member and said first body cantilever mounting lower member disposed in a spaced relationship thereby defining a first cantilever mounting slot; and wherein said first body cantilever mounting lower member is longer than said first body cantilever mounting upper member.

2. The support device of claim 1 wherein said first body includes a vertical orientation device.

3. The support device of claim 2 wherein said first body vertical orientation device is a thick first body.

4. The support device of claim 2 wherein said first body vertical orientation device includes a number of lateral support members.

5. The support device of claim 1 wherein said first body support surface is disposed on the upper surface of said upper member.

6. The support device of claim 1 wherein said mounting beam includes a first flange second portion, said first flange second portion extending generally horizontally on the opposite side of said web from said first flange first portion and wherein:

said first body includes a first coupling assembly;

said support assembly includes a locking, second body, said second body defining a cantilever mounting and including a second coupling assembly;

said second body cantilever mounting corresponding to said first flange second portion; and said first coupling assembly coupled to said second coupling assembly.

7. The support device of claim 6 wherein said second body includes a support surface.

8. The support device of claim 1 wherein:

said first body includes a vertical extension and a number of lower support surfaces;

said first body vertical extension extending generally vertically and downwardly from said first body cantilever mounting; and each said lower support surface extending generally horizontally from said first body vertical extension.

9. A support device for a generally horizontally extending mounting beam, said beam including a generally vertical web and a generally horizontal first flange having a first portion disposed to one side of said web, said support device comprising:

a support assembly including an elongated first body defining a cantilever mounting and a support surface;

said first body cantilever mounting corresponding to said first flange first portion;

wherein said first body includes a vertical orientation device;

wherein said first body vertical orientation device includes a number of lateral support members; and wherein a number of said lateral support members are resilient.

10. A support device for a generally horizontally extending mounting beam, said beam including a generally vertical web and a generally horizontal first flange having a first portion disposed to one side of said web, said support device comprising:

a support assembly including an elongated first body defining a cantilever mounting and a support surface;

said first body cantilever mounting corresponding to said first flange first portion;

wherein said first body includes a vertical orientation device; and wherein said first body vertical orientation device is a first lateral mirror body disposed in a spaced relationship with said first body.

11. A support device for a generally horizontally extending mounting beam, said beam including a generally vertical web and a generally horizontal first flange having a first portion disposed to one side of said web, wherein said mounting beam includes a first flange second portion, said first flange second portion extending generally horizontally on the opposite side of said web from said first flange first portion, said support device comprising:

a support assembly including an elongated first body defining a cantilever mounting and a support surface;

said first body cantilever mounting corresponding to said first flange first portion;

said first body includes a first coupling assembly;

said support assembly includes a locking, second body, said second body defining a cantilever mounting and including a second coupling assembly;

said second body cantilever mounting corresponding to said first flange second portion;

said first coupling assembly coupled to said second coupling assembly;

said first body cantilever mounting includes an upper member and a lower member;

said first body cantilever mounting upper member and said first body cantilever mounting lower member disposed in a spaced relationship thereby defining a first cantilever mounting slot;

said first coupling assembly includes a first opening and a first fastener component, said first opening disposed on said first body cantilever mounting lower member;

said second body cantilever mounting includes an upper member and a lower member;

said second body cantilever mounting upper member and said second body cantilever mounting lower member disposed in a spaced relationship thereby defining a second cantilever mounting slot; and said second coupling assembly includes a second opening and a second fastener component, said second opening disposed on said second body cantilever mounting lower member.

12. The support device of claim 11 wherein:

said first opening is an elongated generally horizontal slot; and said second opening is an elongated generally horizontal slot.

13. A support device for a generally horizontally extending mounting beam, said beam including a generally vertical web and a generally horizontal first flange having a first portion disposed to one side of said web, wherein said mounting beam includes a first flange second portion, said first flange second portion extending generally horizontally on the opposite side of said web from said first flange first portion, said support device comprising:

a support assembly including an elongated first body defining a cantilever mounting and a support surface;

said first body cantilever mounting corresponding to said first flange portion;

said first body includes a first coupling assembly;

said support assembly includes a locking, second body, said second body defining a cantilever mounting and including a second coupling assembly;

said second body cantilever mounting corresponding to said first flange second portion;

said first coupling assembly coupled to said second coupling assembly;

said first body cantilever mounting lower member is longer than said first body cantilever mounting upper member; and said second body cantilever mounting lower member is longer than said second body cantilever mounting upper member.

14. A support device for a generally horizontally extending mounting beam, said beam including a generally vertical web and a generally horizontal first flange having a first portion disposed to one side of said web, wherein said mounting beam includes a first flange second portion, said first flange second portion extending generally horizontally on the opposite side of said web from said first flange first portion, said support device comprising:

a support assembly including an elongated first body defining a cantilever mounting and a support surface;

said first body cantilever mounting corresponding to said first flange first portion;

said first body includes a first coupling assembly;

said support assembly includes a locking second body said second body defining a cantilever mounting and including a second coupling assembly;

said second body cantilever mounting corresponding to said first flange second portion;

said first coupling assembly coupled to said second coupling assembly;

said first body includes a vertical orientation device; and said second body includes a vertical orientation device.

15. The support device of claim 14 wherein:

said first body vertical orientation device is a thick first body; and said second body vertical orientation device is a thick second body.

16. The support device of claim 14 wherein:

said first body vertical orientation device includes a number of lateral support members; and said second body vertical orientation device includes a number of lateral support; members.

17. The support device of claim 16 wherein a number of said lateral support members are resilient.

18. The support device of claim 14 wherein:

said first body vertical orientation device is a first lateral mirror body disposed in a spaced relationship with said first body; and said second body vertical orientation device is a second lateral mirror body disposed in a spaced relationship with said second body.

* * * * *

UNITED STATES PATENT AND TRADEMARK OFFICE

CERTIFICATE OF CORRECTION

PATENT NO. : 9,238,299 B2
APPLICATION NO. : 14/148901
DATED : January 19, 2016
INVENTOR(S) : Noah It is certified that error appears in the above-identified patent and that said Letters Patent is hereby corrected as shown below:

In the specification
Column 2, line 18, delete “a I-shaped” insert --an I-shaped--.
Column 2, line 63, delete “assemblies” insert --assembly--.
Column 7, line 57, delete “coupled the” insert --coupled to the--.
In the claims
Column 12, line 52, Claim 1, delete “disposed one” insert --disposed to one--.
Column 16, line 10, Claim 16, delete “support; members.” insert --support members.--.

Signed and Sealed this
Second Day of August, 2016

Michelle K. Lee

Michelle K. Lee
*Director of the United States Patent and Trademark Office*